United States Patent [19]

Holden et al.

[11] 4,313,384

[45] Feb. 2, 1982

[54] PEDESTAL LINER FOR RAILWAY VEHICLE AND METHOD OF MAKING SAME

[75] Inventors: Homer N. Holden, Sylva, N.C.; Donald L. Kleykamp, Dayton, Ohio; William F. Moore, Villa Park, Ill.; Julien C. Mathieu, Waynesville, N.C.

[73] Assignee: Dayco Corporation, Dayton, Ohio

[21] Appl. No.: 167,292

[22] Filed: Jul. 10, 1980

[51] Int. Cl.[3] ..... B61F 5/32

[52] U.S. Cl. ..... 105/225; 29/149.5 R; 308/3 R

[58] Field of Search ..... 105/199 C, 199 CB, 207, 105/221 R, 225; 308/3 R, 238; 29/149.5 R, 149.5 S, 149.5 NM

[56] References Cited

U.S. PATENT DOCUMENTS

| | | | |
|---|---|---|---|
| 3,554,618 | 1/1971 | Ditzler et al. | 308/3 R |
| 4,170,180 | 10/1979 | Houston | 105/225 |
| 4,237,793 | 12/1980 | Holden et al. | 105/225 |
| 4,239,007 | 12/1980 | Kleykamp et al. | 105/225 |

*Primary Examiner*—Randolph A. Reese

*Attorney, Agent, or Firm*—Joseph V. Tassone

[57] ABSTRACT

A pedestal liner for a railway vehicle and method of making same are provided wherein such liner comprises a roughly U-shaped metal support comprising the main structural portion of the liner with the metal support having a bight and a pair of parallel legs and an insert is provided and carried by the metal support. The insert has a pair of roughly parallel members which have outer portions disposed outwardly of and parallel to the parallel legs of the support and the parallel members are comprised of antifriction material; and, the insert has an integral arm extending transverse its members with the arm also being comprised of antifriction material. The insert is adapted to be readily installed on and removed from the metal support and is held in position mainly by surface portions of the metal support to define the pedestal liner.

25 Claims, 9 Drawing Figures

PEDESTAL LINER FOR RAILWAY VEHICLE AND METHOD OF MAKING SAME

BACKGROUND OF THE INVENTION

1. Field of the Invention

This invention relates to railway vehicles and more particularly to pedestal liners for pedestal trucks of railway vehicles.

2. Prior Art Statement

Pedestal liners are widely used in the railway industry for the purpose of protecting the relatively slideable surfaces of a pedestal leg and journal box of a pedestal truck against excessive wear.

For example, U.S. Pat. No. 3,554,618 discloses a U-shaped pedestal liner consisting of a bight and a pair of parallel legs which has an inserted nylon wear plate for the bight which is unsupported in the central portion of the bight and which is free of antifriction material on the outside surfaces of the parallel legs where substantial wear may also occur in a pedestal liner.

U.S. Pat. No. 4,170,180 discloses a pedestal liner comprised of two main components wherein one component is U-shaped and made entirely of polymeric material and the other component is a sheet-like insert also made entirely of polymeric material.

Copending U.S. Patent application Ser. No. 30,035, filed Apr. 13, 1979, now U.S. Pat. No. 4,237,793, discloses a U-shaped pedestal liner having a bight and a pair of parallel legs and such liner is comprised of a continuous uninterrupted metal backing material defining the bight and parallel legs and antifriction material in the form of an ultra high molecular weight polymeric material fixed against the bight and parallel legs of the backing material whereby the backing material provides optimum support for the antifriction material.

Copending U.S. Patent application Ser. No. 30,036, filed Apr. 13, 1979, now U.S. Pat. No. 4,239,007, discloses a U-shaped pedestal liner having a bight and a pair of parallel legs. A first antifriction material is fixed against the bight and a second antifriction material is fixed against the parallel legs with the first and second antifriction materials being ultra high molecular weight polymeric materials having different wear characteristics.

U.S. Pat. No. 4,188,888 discloses a wear member or liner for center plate structure of a railway vehicle which has reinforcing material embedded therein.

Finally, copending U.S. patent application Ser. No. 160,059, filed June 16, 1980 discloses a pedestal liner comprised primarily of antifriction material in the form of ultra high molecular weight polymeric material and which has a reinforcing structure embedded in the polymeric material which serves as a matrix therefor and substantially completely surrounds such structure and the structure has openings therein for receiving the polymeric material completely therethrough thereby enabling better embedment of the structure and the structure provides reinforcement and prevents cold flow of the polymeric material.

SUMMARY

It is a feature of this invention to provide a U-shaped pedestal liner for use between a pedestal leg and journal box of a railway pedestal truck wherein such liner may be attached in position in a high strength manner yet utilizes a minimum amount of antifriction material resulting in the pedestal liner being of optimum economy.

Another feature of this invention is to provide a pedestal liner of the character mentioned wherein such liner comprises a roughly U-shaped metal support comprising the main structural portion of the liner with the metal support having a bight and a pair of parallel legs and which utilizes an insert carried by the metal support. The insert has a pair of roughly parallel members which have outer portions disposed outwardly of and parallel to the parallel legs of the support and the parallel members are comprised of antifriction material; and, the insert has an integral arm extending transverse its members with the arm also being comprised of antifriction material. The insert is adapted to be readily installed on and removed from the metal support and is held in position mainly by surface portions of the metal support to define the pedestal liner.

Another feature of this invention is to provide a pedestal liner of the character mentioned in which the metal support thereof provides the main advantages of an all metal liner and the insert thereof provides the main advantages of a liner made substantially entirely of antifriction polymeric material.

Another feature of this invention is to provide a pedestal liner of the character mentioned in which the antifriction polymeric material comprising such insert is ultra high molecular weight polymeric material.

Another feature of this invention is to provide a pedestal liner of the character mentioned in which the ultra high molecular weight polymeric material is polyethylene.

Another feature of this invention is to provide a pedestal liner of the character mentioned in which the parallel members of the insert are disposed in spaced apart parallel planes and the transverse arm of the insert extends in a plane substantially perpendicular to the parallel planes of the members with such arm adjoining associated side edges of such members.

Another feature of this invention is to provide a pedestal liner of the character mentioned in which the insert is a substantially H-shaped insert.

Another feature of this invention is to provide a pedestal liner of the character mentioned in which the insert is a substantially U-shaped insert.

Another feature of this invention is to provide a pedestal liner of the character mentioned in which the insert is substantially U-shaped and has a bight which has a vertical height which is greater than the vertical height of its parallel legs.

Another feature of this invention is to provide a pedestal liner of the character mentioned in which the insert therof is adapted to be installed in position on its associated U-shaped metal support by movement thereof generally in a direction from the bight of its metal support toward the parallel legs of such metal support with the parallel members of the insert being disposed in an embracing relation around the legs of the metal support.

Another feature of this invention is to provide a pedestal liner of the character mentioned in which the insert thereof is adapted to be installed in position on its associated U-shaped metal support by movement thereof generally through the parallel legs of the metal support and toward the bight of such metal support.

Another feature of this invention is to provide a pedestal liner of the character mentioned having an insert which is, in essence, self held mainly by cooperating surface portions of the insert which engage similarly shaped and formed surface portions of the metal support.

Another feature of this invention is to provide an improved method of making a pedestal liner of the character mentioned.

Therefore, it is an object of this invention to provide an improved pedestal liner and method of making same having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DETAILED DESCRIPTION

Figure 1:
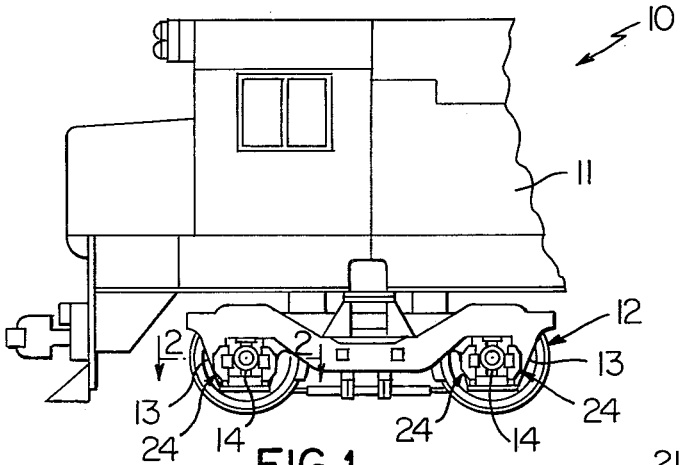
FIG. 1 is a fragmentary side view of a railway locomotive comprising pedestal trucks at its opposite ends and wherein each truck has pairs of pedestal legs and a journal box disposed between each pair of associated pedestal legs with a pedestal liner of this invention being disposed between each associated pedestal leg and journal box.

Reference is now made to FIG. 1 of the drawings which illustrates a fragmentary portion of a railway vehicle which is shown as a portion of a railway locomotive and is designated generally by the reference numeral 10. The locomotive 10 comprises the usual locomotive main body 11 which is supported at each of its opposite ends by a four wheel truck and one of the trucks is shown in FIG. 1 and designated generally by the reference numeral 12. Each truck 12 is a so-called pedestal type truck, which is well known in the locomotive art, and comprises four pairs of pedestal legs with a typical one of such pedestal legs being illustrated in enlarged view in FIG. 2; and, each leg of each pair is designated by the reference numeral 13. The truck 12 has the usual journal box 14 disposed between said associated pair of legs 13.

Figure 2:
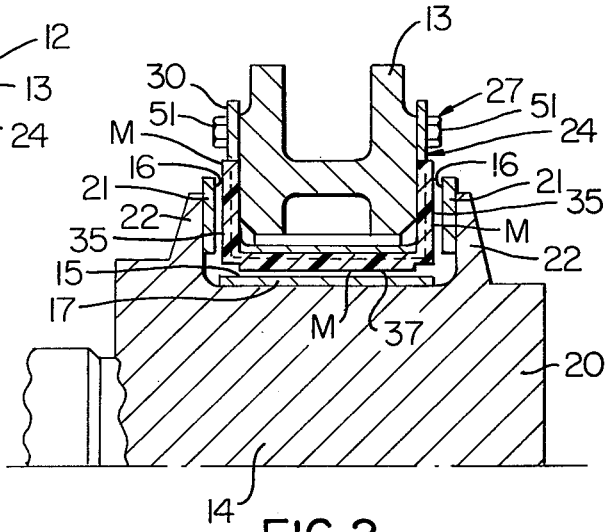
FIG. 2 is a fragmentary enlarged cross-sectional view with parts in cross section and parts in elevation taken essentially on the line 2—2 of FIG. 1 and illustrating a typical pedestal liner of this invention disposed in position between an associated journal box and pedestal leg.

As best seen in FIG. 2, each journal box 14 has a vertically disposed central planar guide surface 15 and a pair of spaced vertically disposed parallel side surfaces 16 disposed on opposite sides of each central guide surface 15. Each central guide surface 15 defines the outside surface of an associated wear plate 17 which is suitably fixed to the main body 20 of the journal box 14 by any suitable means, such as welding, or the like. The side surfaces 16 of the journal box define the outside surfaces of metal plate members 21 which are also suitably fixed, as by welding, to integral extensions 22 which extend from the main body 20 of the journal box 14.

In accordance with the teachings of this invention an improved U-shaped pedestal liner is provided and designated generally by the reference numeral 24.

Figure 3:
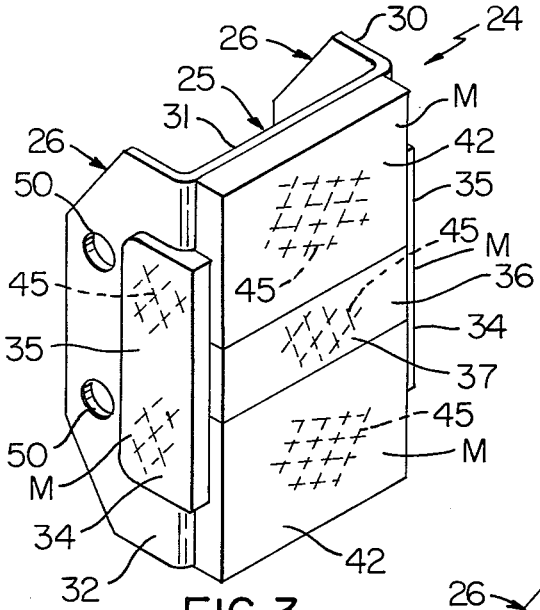
FIG. 3 is a perspective view of the pedestal liner of FIGS. 1 and 2.

The U-shaped pedestal liner 24 is best seen in FIG. 3 and comprises a bight which is designated generally by the reference numeral 25 and a pair of parallel legs each designated generally by the reference numeral 26. The pedestal liner 24 is adapted to be disposed between an associated pedestal leg 13 and journal box 14 and fastened by fastening means 27 to an associated pedestal leg 13 and the fastening means 27 will be described in detail subsequently.

Figure 4:
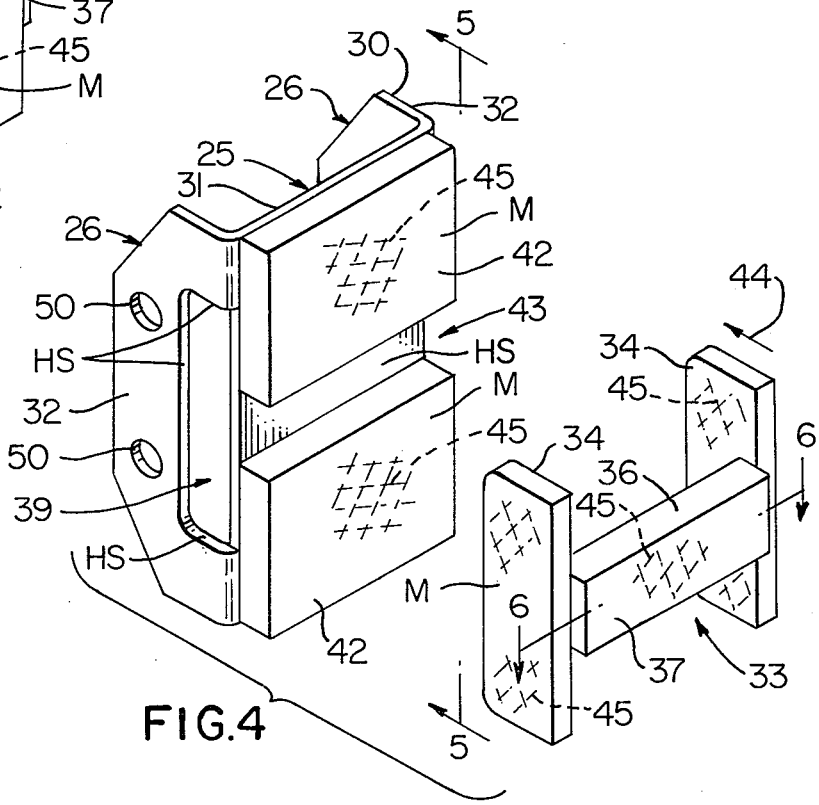
FIG. 4 is an exploded perspective view of the pedestal liner of FIG. 3 particularly illustrating an insert thereof exploded away from the remaining portion of the pedestal liner.

Referring now to FIG. 4 it is seen that the pedestal liner 24 comprises a roughly U-shaped metal support 30 which comprises the main structural portion of the liner 24 and the metal support 30 has a bight 31 and a pair of parallel legs each designated by the same reference numeral 32. The pedestal liner 24 has antifriction material M (FIG. 2) for parallel legs 26 and such antifriction material is supported by the metal support 30 and is adapted to engage the side surfaces 16 of the journal box 14. The pedestal liner 24 also has antifriction material M for its bight 25 and such antifriction material is supported by the metal support 30 and is adapted to engage the guide surface 15 of the journal box 14. The antifriction material M for the parallel legs and bight will be also be described in detail subsequently.

Figure 6:
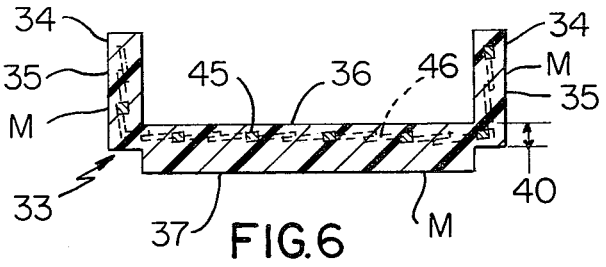
FIG. 6 is a cross-sectional view taken essentially on the line 6—6 of FIG. 4.

The antifriction material for the parallel legs 26 and for the bight 25 comprises an insert which is designated generally by the reference numeral 33 in FIG. 4; and, such insert is comprised of the antifriction material M (FIG. 6). The insert 33 has a pair of roughly parallel members each designated by the same reference numeral 34 which have an outer portions 35 disposed outwardly of and parallel to the parallel legs 32 of the support 30 and the outer portions 35 are adapted to engage the side surfaces 16. The antifriction material M for the parallel legs 26 of the pedestal liner 24 consists solely of the antifriction material M of the roughly parallel members 34 of the insert 33.

The insert 33 has an arm which is designated generally by the reference numeral 36 and the arm extends transverse its parallel members 34. The arm has an outer portion 37 which is adapted to engage the guide surface 15 and the antifriction material M of the arm 36 of the insert 33 comprises the antifriction material of the bight 25 of the pedestal liner 24. The insert 33 is adapted to be readily installed on and removed from the metal support 30 to define the overall pedestal liner 24; and, it will be seen that the liner 33, once installed in position for use, is held in position mainly by surface portions of the metal support as will be described subsequently.

As best seen in FIG. 4 the metal support 30 has cutout means in at least one of the bight 31 and parallel legs 32 thereof. In this example, the cutout means is a rectangular cutout 39 provided at the junction of each leg 32 with the bight 31. Each cutout 39 defines a surface portion or holding surface HS on its leg 32 and it will be seen that each holding surface HS is defined by the thickness of metal defining the support 30 and extends in a U-shaped configuration.

The insert 33 of this example is substantially H-shaped and it will be seen that the parallel members 34 are disposed in spaced parallel relation and in parallel planes. In addition, the transverse arm 36 is disposed substantially centrally between the members 34 with approximately half of its thickness, indicated at 40 in FIG. 6, coinciding with the members 34 at opposite ends of the arm 36. The arm 36 is disposed in a plane perpendicular to the parallel planes of the members 34.

As seen in FIG. 4 of the drawings, the bight 31 of the metal support 30 is a flat substantially rectangular sheet-like portion and the antifriction material for the bight 25 of the overall liner 24 comprises a pair of antifriction members each designated by the same reference numeral 42. The members 42 are of rectangular outline and are fixed to opposite end portions of the rectangular portion defining the bight 31 with a space 43, also of rectangular outline, between the members 42. The space 43 is adapted to receive the rectangular outline transverse arm 36 of the insert 33 in nested relation therewithin so that there is virtually a planar interface contact between each side of arm 36 and its associated member 42. The central part of the rectangular portion of the bight 31 also defines a holding surface HS for the insert 33 and the surfaces of the members 42 which face each other across the space 43 basically are free of loads imposed by the insert 33 and usually do not function as holding surfaces.

The insert 33 is adapted to be installed in position on its metal support 30 by general movement thereof, as indicated by the arrow 44 in FIG. 4, in a general movement direction determined by movement from the bight 31 of the metal support 30 toward the rear portion of its parallel legs 32. As indicated previously, the insert 33 is basically held in position once installed on a pedestal truck mainly by the surface portions or holding surfaces HS of the metal support 31.

Figure 5:
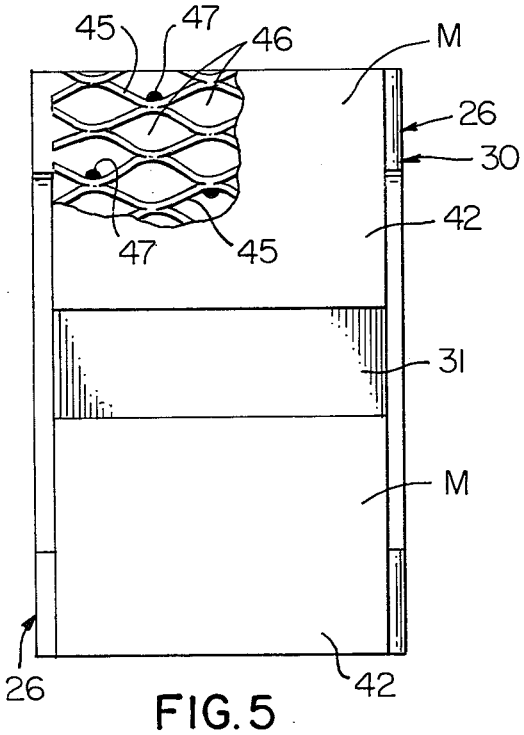
FIG. 5 is a view taken essentially on line 5—5 of FIG. 4 with a fragmentary portion of the pedestal liner broken away to illustrate reinforcing means utilized in polymeric material comprising the upper portion of the bight of such liner.

As indicated previously, the bight 31 of the U-shaped metal support 30 has a pair of antifriction members 42 fixed to opposite end portions of the rectangular configuration of such bight. Each member 42 is also of rectangular outline and is comprised of an antifriction material M preferably in the form of ultra high molecular weight polymeric material, such as polyethylene. Each member 42 has reinforcing means, preferably in the form of a metal reinforcing structure 45, suitably embedded therein (FIGS. 4 and 5) with the reinforcing structure 45 having openings 46 provided therein. The reinforcing structure 45 may be any suitable structure known in the art; however, in this example of the invention such reinforcing structure is in the form of an expanded metal structure. The expanded metal structure 45 is fixed to the bight 31 by any suitable means, such as spot welds 47, for example, whereupon the polymeric material M comprising each member 42 is formed in position therearound. The polymeric material M (which is preferably a molten thermoplastic material) flows through the openings 46 in the reinforcing structure 45 with the polymeric material M serving as a matrix for the reinforcing structure. The reinforcing structure 45 reinforces the polymeric material M while preventing cold flow thereof.

The insert 33 (FIG. 6) has reinforcing means embedded therein, preferably in the form of expanded metal structure 45. The metal structure 45 is embedded in polymeric material M comprising the parallel members 34 and transverse arm 36 thereof and such reinforcing structure 45 also has openings 46 therein which enable flow of material M therethrough and embedment of the structure 45 with the reinforcing material M serving as a matrix for such structure. The reinforcing structure 45 provides reinforcement while preventing cold flow of the polymeric material M, which is also an ultra high molecular weight polymeric material.

The reinforcing structure 45 for the insert 33 is preferably a single-piece metal structure, as best illustrated in FIG. 6 of the drawings, and it will be appreciated that such structure is disposed in an H-shaped configuration corresponding to the H-shaped configuration of the insert 33 and has parallel portions disposed in parallel planes centrally within the members 34 and a transverse portion which is disposed in arm 36 in a plane perpendicular to the parallel planes of the portions within arms 34.

The H-shaped reinforcing structure 45 of insert 33 improves the structural integrity of such insert; and, the polymeric material M of insert 33 defines the exposed or outside surfaces thereof whereby the material M assures that the exposed surfaces of the insert have optimum antifriction properties.

The pedestal liner 24 has means for fastening same to an associated pedestal leg 13; and, in this example of the invention the fastening means comprises a plurality of cylindrical shape holes or bores in the legs 32 of the metal support 30 and each bore is designated by the same reference numeral 50. Each bore is particularly adapted to receive an associated fastener such as a threaded fastening bolt 51 therethrough and for the purpose of fastening the metal support 30 and hence the entire pedestal liner 24 to its pedestal leg 13. Each fastening bolt 51 is threadedly received within a cooperating threaded opening (not shown) in the pedestal leg 13.

Figure 8:
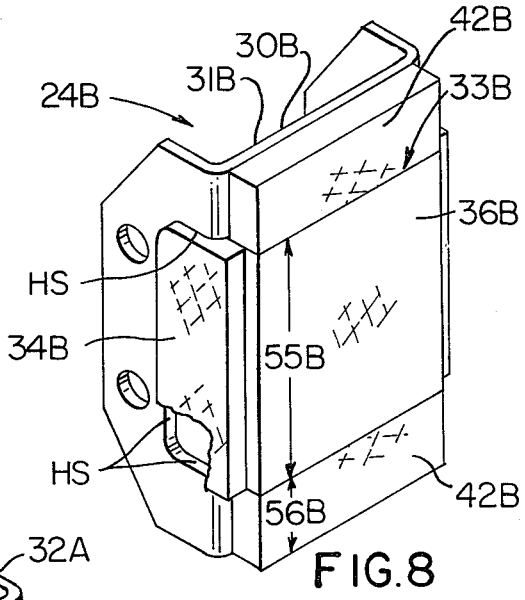
FIG. 8 is a view similar to FIG. 3 illustrating another exemplary embodiment of the pedestal liner of this invention.
Figure 7:
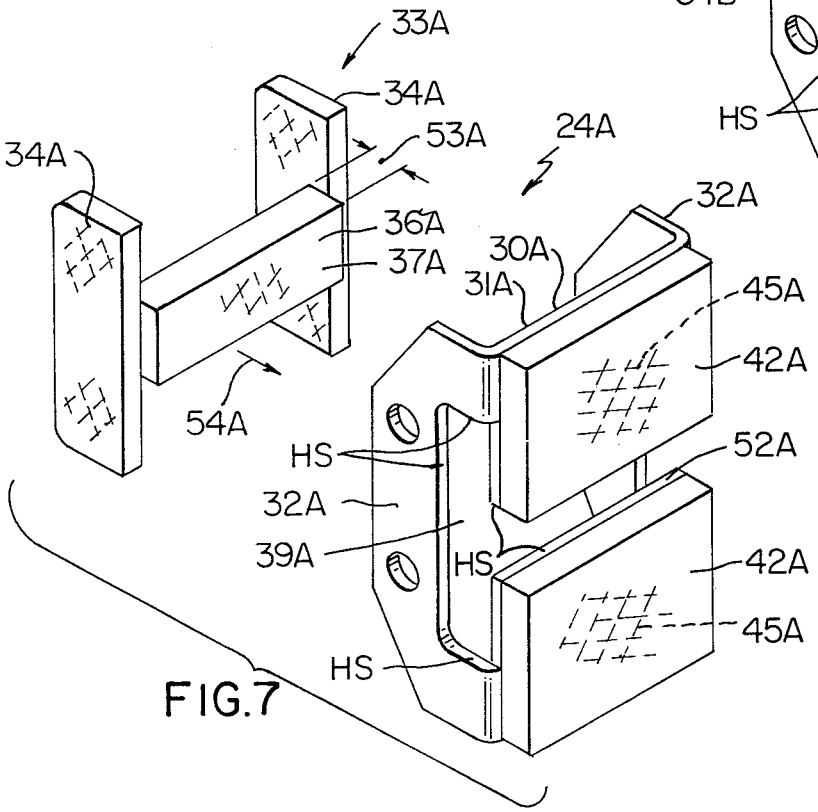
FIG. 7 is a view similar to FIG. 4 illustrating another exemplary embodiment of the pedestal liner of this invention.
Figure 9:
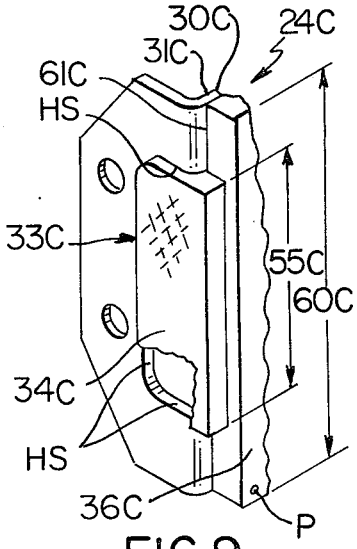
FIG. 9 is a view similar to FIG. 3 illustrating another exemplary embodiment of the pedestal liner of this invention and with portions of such liner broken away.

Other exemplary embodiments of the pedestal liner of this invention are illustrated in FIGS. 7, 8, and 9 of the drawings. The pedestal liners of FIGS. 7, 8, and 9 are very similar to the pedestal liner 24, therefore such pedestal liner will be designated by the reference numeral 24A, 24B, and 24C respectively and representative parts of each pedestal liner which are similar to corresponding parts of the pedestal liner 24 will be designated in the drawings by the same reference numerals as in the pedestal liner 24 (whether or not such representative parts are mentioned in the specification) followed by the associated letter designation A, B, or C respectively. Only those component parts of the pedestal liner 24A, 24B, and 24C which are different from corresponding parts of the pedestal liner 24 will be designated by a new reference numeral also followed by the associated letter designation A, B, or C.

The pedestal liner 24A (FIG.7) also has a U-shaped metal support 30A provided with a bight 31A and parallel legs 32A extending from opposite ends of the bight; however, the flat substantially rectangular portion defining the bight 31A has a central cutout 52A therein which is basically of rectangular outline. The pedestal liner 24A also has a pair of antifriction members 42A each provided with reinforcing structure 45A suitably fixed to opposite end portions thereof in a similar manner as previously described for the pedestal liner 24. The pedestal liner 24A also has an insert 33A which is similar to the insert 33 and is comprised of a pair of parallel members 34A and a transverse arm 36A; however, the transverse arm 36A has a thickness 53A which is greater than the corresponding thickness of the arm 36 by an amount roughly equal to the thickness of the bight 31A of support 30A.

The construction and arrangement of the insert 33A is such that it is adapted to be installed in position by movement thereof through the parallel legs 32A of the metal support 30A in a general direction indicated by the arrow 54A in FIG. 7 and with such movement being generally through the parallel legs 32A and toward the bight 31A of the metal support 30A. At the completion of the movement in the direction 54A, the insert 33A assumes a position such that the liner 24A has an outside appearance which is substantially identical to the pedestal liner 24 illustrated in FIG. 3 whereby the exposed outer portion 37A of the transverse arm 36A of the insert 33A is disposed so that its outside surface is coplanar with the outside surfaces of the members 42A. In addition, the parallel members 34A have outside configurations which correspond to cutout means 39A in the arms 32A of the metal support 30A and the dimensions of the transverse arm 36A correspond to dimensions of the cutout 52A whereby once the insert 33A is installed within U-shaped metal support 30A with the members 42A fixed in position the insert 33A is held by holding surfaces HS of the metal support 30A and may be readily removed and replaced upon excessive wear of its parallel members 34A as well as excessive wear of its central transverse arm 36A.

The main difference between the pedestal liner 24B, of FIG. 8, and the pedestal liner 24 is that the pedestal liner 24B instead of having an insert of H-shaped configuration has an insert 33B of substantially U-shaped configuration. Accordingly, the transverse arm 36B thereof has a vertical height 55B which is equal to the vertical height of the arms 34B. Further, in order to receive the insert 33B the vertical dimension 56B of each member 42B is comparatively small and the arm 36B is backed by a portion of the bight 31B of support 30B which has a vertical height corresponding to the height 55B.

The main difference between the pedestal liner 24C of FIG. 9 and the pedestal liner 24 is that the insert 33C thereof has a transverse arm 36C which has a vertical dimension 60C which is greater than the vertical dimension 55C of the parallel members 34C. However, the transverse arm 36C has a rear surface 61C which is completely supported against movements toward the bight 31C of support 30C, and this is achieved because the bight 31C has a planar uninterrupted surface which supports surface 61C.

The pedestal liner of this invention may be made utilizing method steps as disclosed herein and is preferably made by forming an insert which has a pair of roughly parallel members disposed in spaced parallel planes and an arm extending transverse to and interconnecting the parallel members with such arm being disposed in a plane perpendicular to the parallel planes. As described earlier, the transverse arm may have a vertical height which is substantially less than the vertical height of the parallel members and may be centrally disposed therealong whereby such insert may have a substantially H-shaped configuration as illustrated in FIGS. 4 and 7 for the inserts 33 and 33A. Similarly, the transverse arm may have a vertical height which is substantially equal to the vertical height of the parallel members whereby such insert may have a substantially U-shaped configuration as illustrated in FIG. 8 for the insert 33B. Finally, the transverse arm of the insert may have a vertical height which is greater than the vertical height of its parallel members and indeed the vertical height of the transverse arm may extend over substantially the entire vertical height of the overall pedestal liner and essentially as illustrated in FIG. 9 by the insert 33C.

However, regardless of whether insert 33, 33A, 33B, or 33C is being formed or constructed, the method of making the pedestal liner of this invention comprises the steps of providing cutout means in at least one of the bight and parallel legs of a metal support and disposing one of the four types of insert within the cutout means such that the insert is held in position by holding surfaces comprising the metal support. The insert is disposed within the cutout means such that such insert has outer portions disposed outwardly of and parallel to the parallel legs of the metal support with the outer portions being adapted to engage the side surfaces of an associated journal box and with the transverse arm of the insert having an outer portion which is adapted to engage the guide surface of such associated journal box.

The cutout means in the metal support 30 of the pedestal liner 24 referred to above comprises cutout means or a cutout 39 provided in the parallel legs 32 of the metal support 30. The cutout means provided in the metal support 30A of pedestal liner 24A comprises a cutout 39A provided in the parallel legs 32A of the metal support 30A as well as the rectangular cutout 52A provided in the bight 31A of such metal support. The cutout means provided in the metal support 30B of the pedestal liner 24B comprises cutout means or a cutout 39B provided in the legs 32B of the metal support 30B. Finally, the cutout means provided in the metal support 30C of the pedestal liner 24C comprises cutout means or a cutout 39C provided in the parallel legs 32C of the metal support 30C.

In each of these instances with the cutouts as described each insert 33, 33A, 33B, and 33C is basically held in position by holding surfaces, designated by the reference letters HS, in the metal support of its pedestal liner. In particular, each holding surface HS is defined in the parallel legs of each associated U-shaped metal support 30, 30A, 30B, and 30C. In the case of the pedestal liner 24A the holding surfaces, in addition to the surfaces HS in legs 32A of support 30A, include holding surfaces also designated HS which comprise opposed surfaces defining the cutout 52A in the bight 31A of metal support 30A as shown in FIG. 7 of the drawings.

Each insert 33, 33A, 33B, and 33C may be formed utilizing any suitable technique known in the art; however, each insert is preferably formed by first forming the reinforcing structure 45 which is to be embedded within polymeric material M defining each insert. The forming may be achieved utilizing commercially available forming tools, fixtures, and the like; and, each reinforcing structure is preferably formed using a single-piece metal structure which has opening therein as previously described.

After forming the reinforcing structure for each insert, such reinforcing structure is disposed in an associated mold device and the cooperating components of the mold device are such that they define the final configuration of the insert. With the reinforcing structure suitably supported within the mold device polymeric material M, preferably in the form of a molten thermoplastic material is injected into the mold device under high temperature and pressure conditions, as is known in the art. After injection of the thermoplastic polymeric material, the mold device and polymeric material are suitably cooled whereupon the mold device is disassembled and the insert is removed from such mold device. The completed inserts 33, 33B, and 33C are adapted to be installed in position by movement of each toward their metal support as shown typically by the direction arrow 44 for the insert 33. The insert 33A is installed in position by movement thereof in an opposite direction relative to its support, as shown by the direction arrow 54A.

Reference has been made throughout this disclosure to the holding surfaces HS of each metal support holding each insert to its pedestal liner and this applies to each pedestal liner 24, 24A, 24B, and 24C.

However, it is to be understood that the holding action is basically a confining action whereby each insert is held or confined in position once its pedestal liner is fastened to its pedestal leg and the pedestal leg and pedestal liner are placed in their normal operative association with a journal box 14.

It will also be appreciated that in some applications one or more pins may be used to help hold an insert on its metal support. A typical pin P is shown acting between the insert 33C of the pedestal liner 24C and the bight 31C of its metal support 30C.

Reference has been made throughout this specification to the use of ultra high molecular weight material, such as polyethylene, to define the polymeric material M of each insert and to define the polymeric material M of each member fixed to the bight of the metal support of each pedestal liner 24, 24A, 24B, and 24C. Th molecular weight referred to is at least two million and preferably the molecular weight is within the range of four to six million using polyethylene. In addition, the preferred technique for determining this molecular weight is referred to as the intrinsic viscosity test and is widely used in the United States.

While present exemplary embodiments of this invention, and methods of practicing the same, have been illustrated and described, it will be recognized that this invention may be otherwise variously embodied and practiced within the scope of the following claims.

What is claimed is:

1. In a pedestal liner for a railway vehicle wherein said vehicle comprises; pedestal trucks comprising pairs of pedestal legs; a journal box disposed between each associated pair of pedestal legs; each journal box having a vertically disposed planar guide surface and a pair of spaced vertically disposed parallel side surfaces disposed on opposite sides of said guide surface; said pedestal liner being roughly U-shaped and comprising; a bight and a pair of parallel legs and being adapted to be disposed between an associated pedestal leg and journal box and fastened to the associated pedestal leg; a roughly U-shaped metal support comprising the main structural portion of said liner; said metal support also having a bight and a pair of parallel legs; antifriction polymeric material for said parallel legs of said liner supported by said metal support and adapted to engage said side surfaces; and antifriction polymeric material for said bight of said liner supported by said metal support and adapted to engage said guide surface; said antifriction polymeric material being ultra high molecular weight polymeric material; the improvement in which, said antifriction polymeric material for said parallel legs and at least a portion of said bight of said liner comprises an insert comprised of said antifriction polymeric material and being carried by said metal support, said insert having a pair of roughly parallel members which have outer portions disposed outwardly of and parallel to said parallel legs of said support with said outer portions being adapted to engage said side surfaces, said parallel members comprising said antifriction polymeric material for said parallel legs of said liner, said insert having an arm extending transverse its members with said arm having an outer portion which is adapted to engage said guide surface with said arm comprising at least a portion of said antifriction polymeric material for said bight, and said insert being adapted to be readily installed on and removed from said metal support and held in position by said metal support to define said pedestal liner.

2. A pedestal liner as set forth in claim 1 in which said insert is a substantially H-shaped insert.

3. A pedestal liner as set forth in claim 2 in which said antifriction polymeric material for said parallel legs of said liner consists solely of the antifriction polymeric material of said pair of roughly parallel members of said insert.

4. A pedestal liner as set forth in claim 3 and further comprising fastening means in said parallel legs of said metal support for fastening same and thus said liner to said associated pedestal leg.

5. A pedestal liner as set forth in claim 4 in which said fastening means comprises at least one cylindrical bore in each leg of said metal support and a fastener associated with each bore and adapted to be extended through each bore and fastened to an associated pedestal leg.

6. A pedestal liner as set forth in claim 3 in which said bight of said metal support is defined by a flat substantially rectangular portion and said antifriction polymeric material for said bight of said liner comprises a pair of antifriction members comprised of antifriction polymeric material and fixed to opposite end portions of said rectangular portion with a space therebetween which is adapted to receive said transverse arm of said insert in nested relation therewithin, said insert being adapted to be installed in position by movement thereof in a general direction from the bight of the metal support toward the parallel legs thereof.

7. A pedestal liner as set forth in claim 6 in which each of said antifriction members is of rectangular outline and said space is also of rectangular outline.

8. A pedestal liner as set forth in claim 7 in which each of said antifriction members has reinforcing means embedded in its antifriction polymeric material and said insert has reinforcing means embedded in its antifriction polymeric material.

9. A pedestal liner as set forth in claim 6 and further comprising reinforcing means embedded in the polymeric material of each of said antifriction members, and reinforcing means embedded in the polymeric material comprising said parallel members and transverse arm of said support.

10. A pedestal liner as set forth in claim 9 in which said ultra high molecular weight polymeric material is polyethylene having a molecular weight ranging between four and six million.

11. A pedestal liner as set forth in claim 3 in which said bight of said metal support is defined by a flat substantially rectangular portion and has a central cutout therein, said antifriction polymeric material for said bight of said liner comprises a pair of antifriction members comprised of antifriction polymeric material and fixed to said rectangular portion on opposite sides of said cutout, said cutout is adapted to receive said transverse arm of said insert therewithin, and said insert is adapted to be installed in position by movement thereof in a general direction through said parallel legs of said metal support toward the bight of said metal support with said transverse arm extending through said central cutout.

12. A pedestal liner as set forth in claim 11 in which said cutout in said bight of said metal support is of substantially rectangular outline and corresponds to the rectangular outline of said transverse arm of said insert.

13. A pedestal liner as set forth in claim 11 and further comprising reinforcing means embedded in the polymeric material of each of said antifriction members and reinforcing means embedded in the polymeric material comprising said parallel members and transverse arm of said support.

14. A pedestal liner as set forth in claim 1 in which each of said parallel legs of said metal support has a cutout opening therein which is particularly adapted to receive an inner thickness portion of an associated parallel member of said insert therewithin, each cutout opening defining a holding surface for its parallel leg which is adapted to engage an associated inner thickness portion of and help hold said insert in position.

15. A pedestal liner as set forth in claim 14 in which said ultra high molecular weight polymeric material is polyethylene.

16. A pedestal liner as set forth in claim 1 and further comprising reinforcing means embedded in the polymeric material comprising said parallel members and transverse arm of said insert.

17. A pedestal liner as set forth in claim 16 in which said reinforcing means comprises a metal structure having openings therein and said polymeric material serves as a martrix for said reinforcing means and extends through said openings, said reinforcing means providing reinforcement and preventing cold flow of the polymeric material.

18. A pedestal liner as set forth in claim 17 in which said metal structure defining said reinforcing means is expanded metal structure.

19. A pedestal liner as set forth in claim 1 in which said insert is substantially U-shaped and said transverse arm thereof has a vertical height roughly equal to the vertical height of its parallel members.

20. A pedestal liner as set forth in claim 1 in which said insert is substantially U-shaped and said transverse arm thereof has a vertical height which is greater than the vertical height of its parallel members, said transverse arm defining the entire polymeric material for said bight of said pedestal liner.

21. In a method of making a pedestal liner for a railway vehicle wherein said vehicle comprises; pedestal trucks comprising pairs of pedestal legs; a journal box disposed between each associated pair of pedestal legs; each journal box having a vertically disposed planar guide surface and a pair of spaced vertically disposed parallel side surfaces disposed on opposite sides of said guide surface; said method comprising the steps of; forming a metal support to define a roughly U-shaped configuration therein wherein said support has a bight and a pair of parallel legs extending from opposite side edges of said bight; supporting antifriction polymeric material on said bight of said metal support for engaging said guide surface; supporting antifriction polymeric material on said parallel legs of said metal support for engaging said side surfaces; said antifriction polymeric material being ultra high molecular weight polymeric material; the improvement comprising the steps of, forming an insert which has a pair of roughly parallel members and an arm extending transverse said parallel members, said insert comprising at least a portion of said antifriction polymeric material, providing cutout means in at least one of said bight and parallel legs of said metal support such that said cutout means defines holding surfaces of said metal support, disposing said insert within said cutout means to thereby hold said insert in position employing said holding surfaces, said insert upon being disposed within said cutout means having outer portions of its parallel members disposed outwardly of and parallel to said parallel legs of said support with said outer portions being adapted to engage said side surfaces of said journal box and said arm of said insert having an outer portion which is adapted to engage said guide surface of said journal box.

22. A method as set forth in claim 21 in which said step of forming said insert comprises forming said insert by molding said antifriction polymeric material to define same.

23. A method as set forth in claim 22 in which said step of molding said insert comprises molding said antifriction polymeric material around reinforcing means which comprise said parallel members and transverse arm thereof.

24. A method as set forth in claim 21 in which said step of forming said insert comprises forming said insert such that said parallel members and transverse arm thereof define a substantially H-shaped configuration therefor.

25. A method as set forth in claim 21 in which said step of forming said insert comprises forming said insert such that said parallel members and transverse arm thereof define a substantially U-shaped configuration therefor.

* * * * *